United States Patent [19]

Barothy

[11] 4,164,047

[45] Aug. 14, 1979

[54] MULTIPURPOSE GYMNASIUM

[75] Inventor: Janos Barothy, Eggenvil, Switzerland

[73] Assignee: Laszlo F. Arato, Buochs, Switzerland; a part interest

[21] Appl. No.: 815,514

[22] Filed: Jul. 14, 1977

[30] Foreign Application Priority Data

Jul. 16, 1976 [CH] Switzerland ..... 09121/76

[51] Int. Cl.[2] ..... E04H 3/19; E04H 3/14

[52] U.S. Cl. ..... 4/172.11; 4/172; 4/172.12; 52/39; 52/309.11

[58] Field of Search ..... 4/172, 172.11, 172.12, 4/172.13, 172.14, 172.19, 173 R, 160–164, DIG. 17; 128/372, 369, 370; 52/39, 126, 169.7, 309.11, 618, 625, 795–798, 814; 428/315

[56] References Cited

U.S. PATENT DOCUMENTS

| | | | |
|---|---|---|---|
| 2,848,722 | 8/1958 | Choporis | 4/172.14 |
| 3,091,777 | 6/1963 | Pearlson | 4/172.13 |
| 3,241,157 | 3/1966 | Baker et al. | 4/172.11 |
| 3,644,941 | 2/1972 | Kuss | 4/172 |
| 3,755,827 | 9/1973 | Riedel et al. | 4/DIG. 17 |
| 3,861,674 | 1/1975 | Buck | 428/315 X |

FOREIGN PATENT DOCUMENTS

| | | | |
|---|---|---|---|
| 1509408 | 3/1969 | Fed. Rep. of Germany | 52/618 |

*Primary Examiner*—Stuart S. Levy
*Attorney, Agent, or Firm*—Darby & Darby

[57] ABSTRACT

A cover for the swimming pool of a multipurpose gymnasium formed of one or more sections of metal, having an undulating bend with the cavities between the bends filled with a plastic foam material to increase its strength and to act as a sound and vibration damping material. The cover is suspended from the ceiling of the gymnasium by cables and lowered into place to cover the open area of the pool. Ultraviolet lamps are also mounted on the bottom of the cover and these lamps extend partway into the pool water when the cover is in place on the pool.

9 Claims, 3 Drawing Figures

MULTIPURPOSE GYMNASIUM

The invention concerns a multipurpose gymnasium with a swimming pool.

Swimming pools are already known which are provided with a cover to prevent water pollution and/or to reduce heat emission by evaporation, this cover consisting of numerous relatively light-weight elements, so that they can be placed on the edge of the swimming pool by hand or from a roll. For safety reasons, these elements must be sufficiently strong to be able to support a person, but they need not be designed to be walked on, and they can not absorb major stresses.

The present invention is based on the problem of making a hall provided with a swimming pool usable as a general purpose gymnasium. The difficulty in the solution of this problem was in that the cover must be easily and rapidly removable and must be able to absorb the stresses encountered in the physical type, e.g. table tennis, tennis, dancing, gymnastics.

This problem is solved in accordance with the present invention in a satisfactory manner by a swimming pool cover which suspended from the ceiling of the hall and which can be lowered to be applied tightly on the edge of the swimming pool. The cover includes one or more large-surfaced compound light-weight elements, having a bottom load capacity sufficient for sporting purposes (this being substantially equivalent to the supporting capacity of conventional roof constructions).

In a preferred embodiment of the invention, the compound element is formed of sheet metal having an undulating bend in which the cavities of the sections formed by the bends are filled with foam material. The bend of the sheet metal advantageously can have the form of a rectangular wave so that the walls defining the cavities of the sections extend in the direction of the load, and thus have a maximum resistance moment. By filling the cavities with a rigid foam material, such as polystyrene foam (STYROPOR), the strength as well as the absorption of the sounds and vibrations by the cover can be further increased.

The suspension of the swimming pool cover can be effected by cables which pass over rolls secured on the hall ceiling, with the ends of the cables secured on the cover.

In a preferred embodiment of the invention ultra-violet type (UV) lamps are secured on the underside of the cover, so that they irradiate the swimming pool intensively when the cover is attached, thus contributing substantially by their germicidal action to keeping the water and the swimming pool wall clean. This has the further advantage that additions of chemicals to the water, which feel very unpleasant to the swimmers, as known, can be avoided. With the cover pulled up, the UV-lamps can serve to irradiate the swimming pool user in the manner of a "solarium."

The housing of the UV-lamps can comprise a glass tub which encloses the UV-lamp and which dips at least partly into the water when the cover is lowered. This results in a good irradiation of the swimming pool, and the evaporation space between the cover and the water surface can be kept at a minimum to keep the heat losses down.

The invention will be described below on the basis of an embodiment represented in the drawing, in which.

Figure 1:
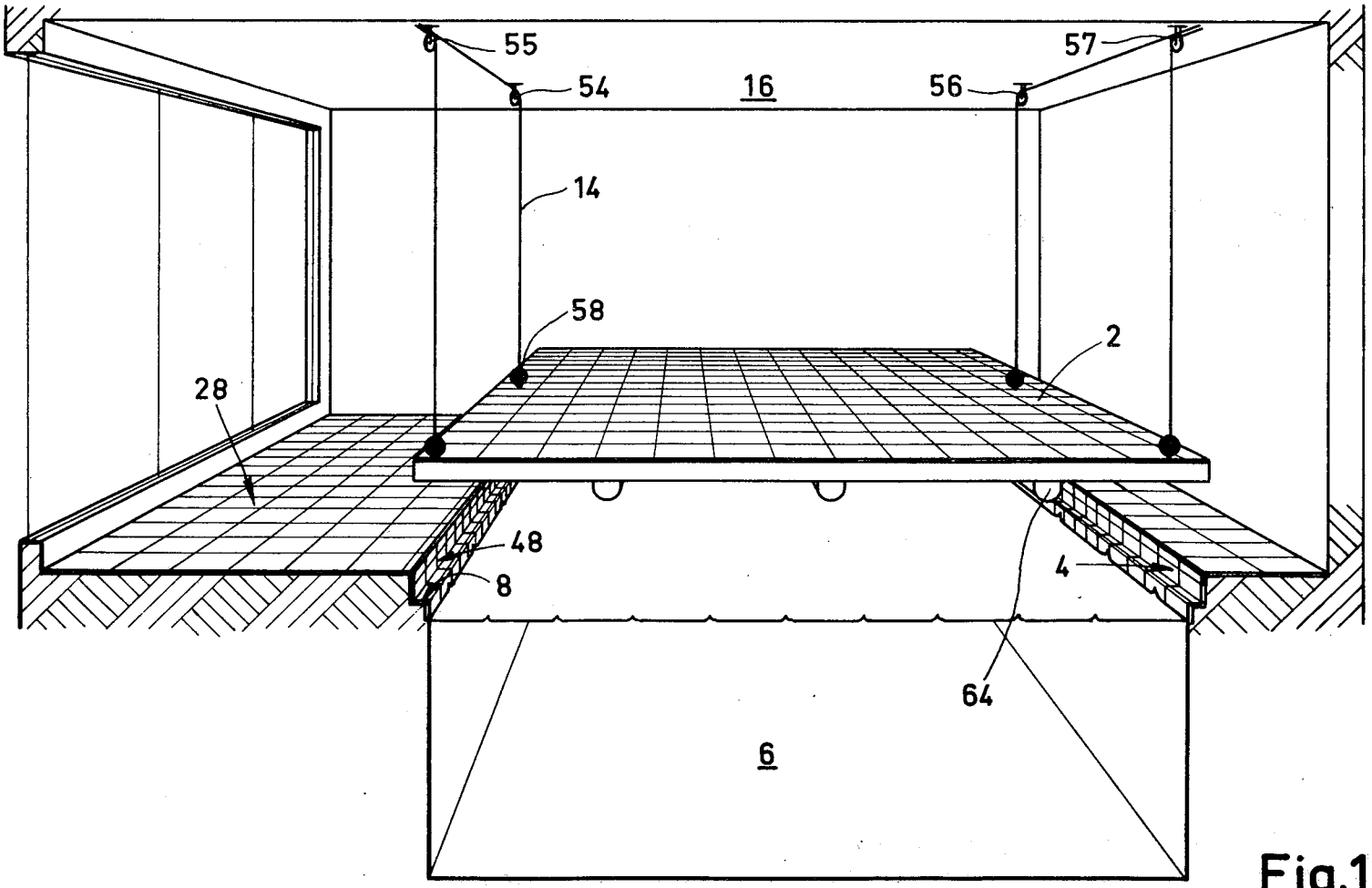
FIG. 1 shows a cross section through a multipurpose gymnasium represented in a perspective view.

In the represented embodiment according to FIG. 1, swimming pool cover 2 comprises a one-part compound element which is slightly larger than the surface of swimming pool 6, so that it can be attached tightly on a sealing strip 8 extending along a stepped edge 4 of the swimming pool. The width of the swimming pool is 3.80 m, for example, so that the swimming pool or the multipurpose gymnasium can be installed in a private home.

The compound design of cover 2 (FIG. 2) is made of a thin-wall profiled strong material, e.g. steel plate 10, of 0.5 mm thickness, for example. Other metals also can be used. The cover 2 has an undulating bent cross-section, the cross-section here being shown as rectangular. It also may be curved or square but the rectangular section gives a more desirable load supporting character. A light-weight and rigid filling material, such as STYROPOR, fill in the spaces between the bends. The entire cover 2 has a relatively low weight with sufficient strength, and can be secured on ceiling 16 of the hall, suspended on four cables 14, for example. The filling material 12 is in close contact with the preferably rectangularly profiled steel plate, so that it increases the buckling strength of the plate and contributes to the absorption of acoustic and mechanical vibrations. It can be introduced into the cavities 18, 20 in liquid form or in the form of solid strip material. It is preferred that the heighth of the vertical wall of the plate be at least about 80% of the total thickness of the cover. Using the bent plate construction with the foam filled cavities the cover is quite strong and can have a load supporting capacity approaching that of the roof.

Above the undulating load support section of the stainless steel plate extends an elastic insulating layer, 22, e.g. of foam. The top and underside of cover 2 are formed by a water-proof plate 24, 26, e.g. of tarboard. On cover 2, as well as on the surrounding floor 28 of the hall can be placed a carpet material 30, e.g. of lattice shaped plastic mats, as it is customary in gymnasiums. This carpet material 30 likewise contributes to the absorption and distribution of locally acting impact forces.

Figure 3:
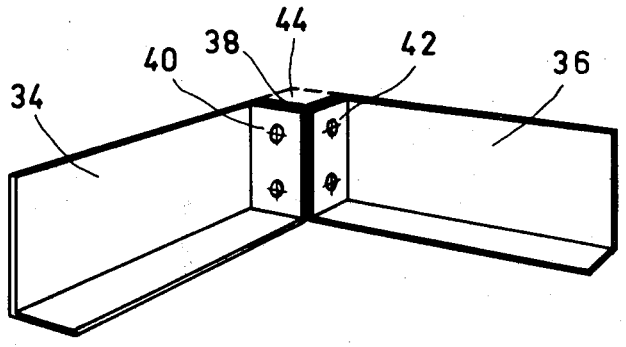
FIG. 3 shows a perspective partial view of the frame bordering the cover.

Cover 2 is bordered by a steel section frame which consists of angular steel sections 34, 36 which are bolted with each other at their corners or ends, as represented in FIG. 3. To this end a short vertical angular section 38 is provided in the frame corners, and a steel plate 40, 42 is welded to the end of sections 34, 36. The openings 44 remaining at the top in the corner can be covered by a welded-on steel plate (not shown) or plug. The connection with one end of each cable 14 is provided at a corner.

This type of corner connection permits a relatively simple correction of the dimensions of cover 2 by inserting shims between steel plates 42, 40 and the angular sections, so that it can be lowered with a minimum gap onto edge section 48 of the swimming pool. Edge section 48 has a right-angled cross section and carries on its horizontal part 52, 50 an elastic rubber sealing strip 8. The length of vertical section 52 corresponds substantially to the thickness of the cover, e.g. 150 mm, so that there is a flat transition from the hall floor 28 to the surface of the attached cover 2.

After cover 2 is lowered, cables 14 can be detached and pulled upward over rollers 54 to 57 until their ends loaded by weights 58 are in the ceiling. The looped cable ends 62 are received through a recess 60 on the underside of weights 58. The fastening element 46, designed as a spring book, can be submerged in an opening of cover 2. Naturally, suitable safety devices are provided (not shown) to prevent accidental lowering of the cover secured on the ceiling.

Figure 2:
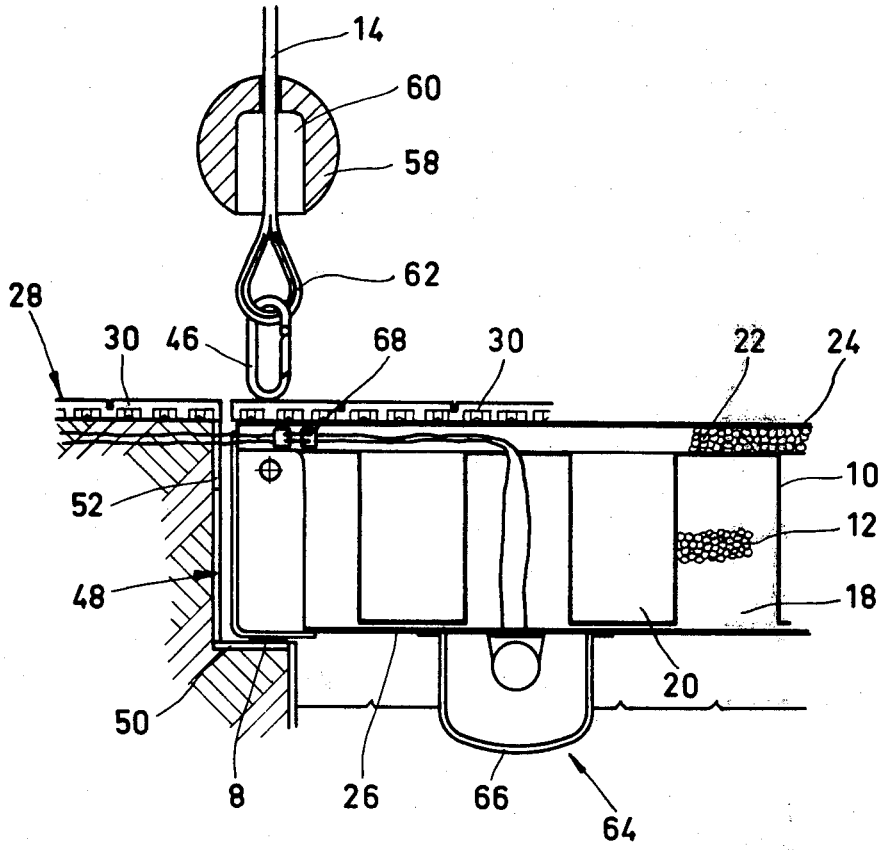
FIG. 2 shows a partial cross section through the attached cover.

The UV-lamps are tightly secured in several rows on the underside of cover 2 so that no water can get into their tub-shaped housings 66. They preferably dip partly into the water, as shown in FIG. 2. For the electrical connection (68), indicated schematically in FIG. 2, a depression (not shown) can be provided next to the swimming pool edge at one or several points of the floor, with a hinged lid, which contains a moisture-proof electrical line unit.

What is claimed is:

1. In combination for a multipurpose gymnasium having a ceiling, a swimming pool having at least two stepped edges located within a floor area, a swimming pool cover of the same general shape as the swimming pool and adapted to rest on said swimming pool stepped edges and be substantially flush with the floor area surrounding the pool, said cover including a top surface on a compound load support element, said load support element being of sheet metal material substantially about 0.5 mm thick which is undularly bent and formed of a generally rectangular shape to define cavities, the height of each section of said load support element being at least about 80% of the thickness of the cover, and foam plastic material filling said cavities and in contact with the sheet metal material to strengthen said load support element and prevent deformation of the load support, and means located on the ceiling for suspending the cover above the pool and for raising said cover from and lowering it to rest on said stepped edges of the pool.

2. A multipurpose gymnasium according to claim 1 further comprising a plurality of UV-lamps secured on the underside of the cover.

3. A multipurpose gymnasium according to claim 2 further comprising a housing for each said UV-lamp, said housing dipping at least partly into the water of the swimming pool when the cover is fitted on the pool.

4. A multipurpose gymnasium according to claim 1 further comprising a frame for the periphery of the cover, said frame having corner sections (34,36) which are fastened with each other at the frame corners.

5. A multipurpose gymnasium according to claim 1 further comprising an elastic insulating layer on the upper portion of said load support element.

6. A multipurpose gymnasium according to claim 5 further comprising water proof plates attached to the top and to the underside of the cover.

7. A multipurpose gymnasium according to claim 5 further comprising plastic foam material between the cover top surface and the upper portion of said load support element.

8. The combination of claim 1 wherein the vertical extensions of the material forming the substantially rectangular cavities of said compound load support element are longer than the horizontal extensions.

9. The combination of claim 1 further comprising an elastic sealing member on the horizontal portion of the stepped edge of said pool.

* * * * *